US006904847B2

(12) United States Patent
Bielka

(10) Patent No.: US 6,904,847 B2
(45) Date of Patent: Jun. 14, 2005

(54) REMOVABLE OR INVERTABLE IN-SITU MODEL RAILROAD WHEEL CLEANER

(76) Inventor: Robert P. Bielka, 2211 N. 59th St., Seattle, WA (US) 98103

( * ) Notice: Subject to any disclaimer, the term of this patent is extended or adjusted under 35 U.S.C. 154(b) by 0 days.

(21) Appl. No.: 10/713,631

(22) Filed: Nov. 13, 2003

(65) Prior Publication Data

US 2005/0103878 A1 May 19, 2005

(51) Int. Cl.[7] ..... B61B 12/00; E01B 23/00
(52) U.S. Cl. ..... 104/307; 238/10 E
(58) Field of Search ..... 104/165, 279, 104/280, 307, DIG. 1; 238/10 R, 10 A, 10 B, 238/10 E

(56) References Cited

U.S. PATENT DOCUMENTS 5,991,952 A * 11/1999 Bintzler et al. ..... 15/53.4
6,536,355 B1 * 3/2003 Amemiya ..... 105/1.5
6,758,145 B1 * 7/2004 Hefter ..... 104/279

* cited by examiner

*Primary Examiner*—S. Joseph Morano
*Assistant Examiner*—Robert J. McCarry, Jr.
(74) *Attorney, Agent, or Firm*—Graybeal Jackson Haley LLP

(57) ABSTRACT

The invention is directed to an apparatus to assist a model railroad hobbyist in cleaning driven or non-driven wheels of a locomotive or car. To achieve this objective, removable and invertable embodiments of the invention are disclosed. The invention provides a convenient means for replacing a conventional track segment with a dedicated cleaning segment. In one series of embodiments, a conventional track segment is replaced with a cleaning segment; in another series, a conventional segment is mounted to a support on an obverse side while a cleaning segment is mounted on a reverse side thereof. Nonlinear rail contacts are used to establish electrical continuity between the track and the mounted segments. Removal, inversion, and replacement of the support permits the user to change the segment in use. In yet another series of embodiments, the support is rotatable, thereby permitting the user to merely rotate the support from one segment to the other.

20 Claims, 11 Drawing Sheets

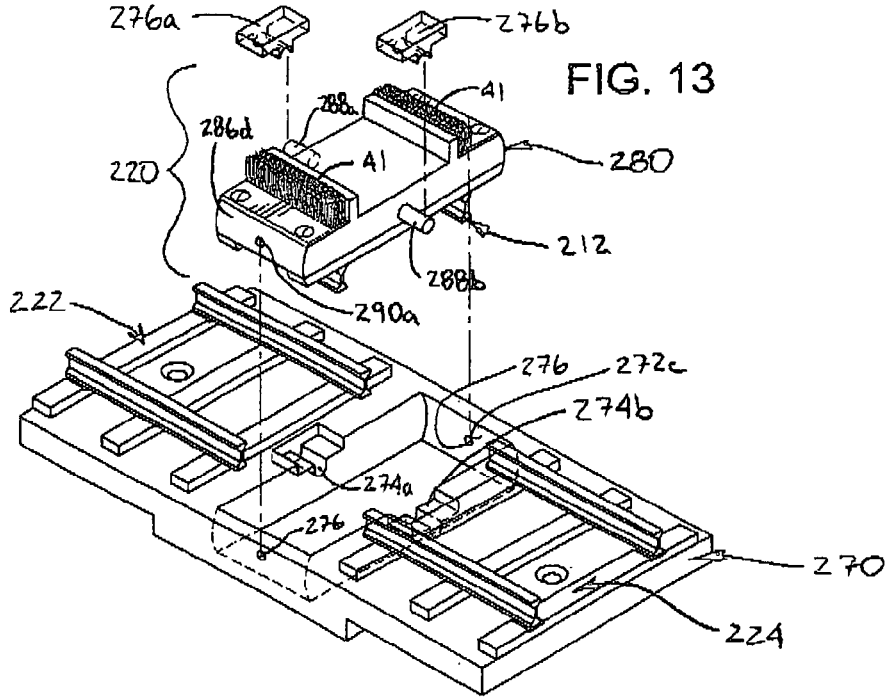
FIG. 13
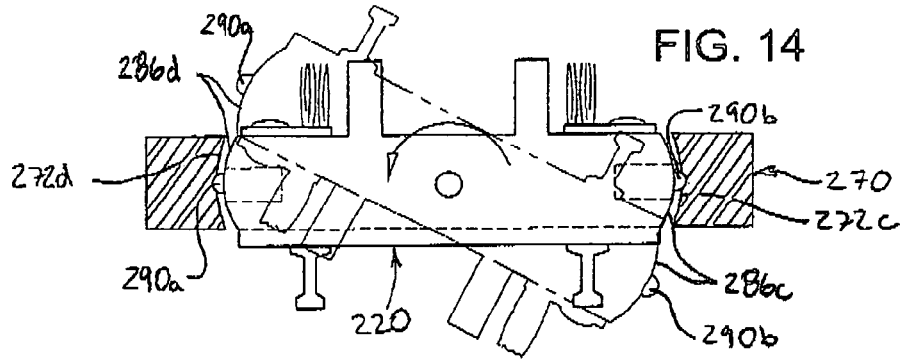
FIG. 14
FIG. 15
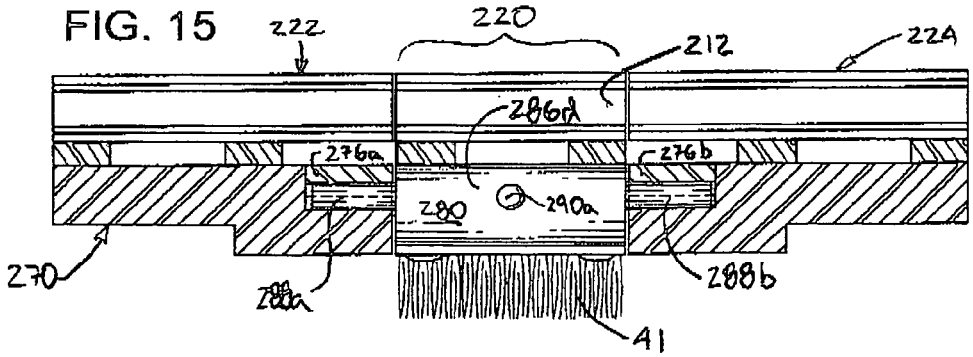

REMOVABLE OR INVERTABLE IN-SITU MODEL RAILROAD WHEEL CLEANER

FIELD OF THE INVENTION

The invention relates to model railroading, and in particular, to a removable or invertable layout accessory that is used to removed oxidation and detritus from driven wheels used by model train locomotives in one embodiment, and non-driven wheels in another embodiment.

BACKGROUND

The predominant mode of cleaning driven wheels of a model railroad locomotive and/or car has relied upon the use of a brush with brass bristles separated by a plastic divider. This assembly is operatively connected by wires having electrical alligator clips to the rails of the model railroad or to the terminals of a suitable power supply during the cleaning process. The conductive properties of the bristles permit the locomotive to receive power therefrom, which in turn causes the driven wheels to rotate. The interaction between the bristles and the rotating wheels then removes the oxidation and detritus. During this operation, however, it was necessary to remove the locomotive and/or car from the track and hold it in the inverted position during the cleaning operation. Often times, the detail parts installed on the upper surfaces of the locomotive and/or car were inadvertently damaged during this process. While use of a cradle during cleaning reduced the likelihood of damage, it still required that the locomotive and/or car be inverted and manipulated. Moreover, the cleaning assemblies of the prior art required additional storage when not in use.

SUMMARY OF THE INVENTION

The invention is directed to a removable and/or invertable in situ assembly for removing oxidation and detritus from driven and/or non-driven wheels of model railroad locomotives and/or cars, and to methods thereof. The invention is found in embodiments that are both semi-permanent and removable, as well as embodiments that feature passive cleaning and active cleaning features. In all embodiments, the invention is integratable into a model railroad layout comprising a track secured to a mechanical ground or base such as the layout table. The track comprises a first rail spaced apart from a second rail by a distance "D". Furthermore, a space in the track layout is defined by a removed track segment. The resulting structure is a track layout having a space or gap where the track has a first end terminating at one end of the space and a second end terminating at the other end of the space. In addition, all embodiments comprise a removable and/or rotatable in situ wheel cleaning apparatus having a replacement segment (a cleaning segment and/or a track segment) sized to generally fit within the space, wherein the replacement segment comprises a first rail interface element spaced apart from a second rail interface element to operably receive the wheels of the locomotive and/or car.

While the complexity of the cleaning segment varies from embodiment to embodiment, at least the first rail interface element thereof comprises a cleaning surface for contacting at least one wheel of the locomotive and/or car. The cleaning surface may be abrasive, e.g., a bristle brush, or capable of carrying an abrasive or solvent, e.g., a foamed polymer; it may be conductive and electrified as disclosed herein with respect to the preferred embodiments or not. If it is not electrified, then preferably any track segment or extension in contact with the rail interface is electrified if the cleaning surface is passive (non-moving). Depending upon the embodiment, the second rail interface element may also comprise a cleaning surface. Moreover, either one or both rail interfaces may comprise at least one rail extension, in addition to a cleaning surface. A rail extension may operate to link the cleaning surface with the layout track or other component.

For a track segment, which permits the layout to smoothly operate without the presence of the cleaning segment, both rail interface elements are preferably rails, the objective being to conceal the presence of the space or gap defined by the layout. While the cleaning segment need not be electrified, at least one rail of the track segment does (such as when an overhead wire or catenary wire is used). Thus, all embodiments including a track segment may include at least one means for delivering power from at least one rail of the layout to the first track interface element of the track segment.

The first embodiment of the invention represents a simplistic manifestation of where features thereof include a removable cleaning segment and a variety of connector means for electrically coupling at least one rail of the layout to the first element of the replacement track segment and, in a preferred embodiment, the cleaning segment. With respect to the connector means, a spring rail contact or a rotary contact arrangement can be used. The spring rail contact comprises a portion for engaging at least one layout rail and at least one extending biased rail contacting portion. The at least one extending biased rail contacting portion can be a "U" shaped configuration or can be a leaf spring arrangement. The objective is to provide a means for establishing a compressive electrical connection with the first element so that when the replacement segment occupies the space, a suitable electrical connection is established.

The rotary contact arrangement comprises a first contact having a conductor receiving portion for, preferably, engaging a layout rail, and defining a hole. The arrangement further comprises a second contact having a conductor receiving portion and a tab wherein the second contact is located proximate to the first contact when the replacement segment occupies the space created by the removed track segment. To operatively link the two contacts, a conductive rotary element is provided having a shaft and an extending contacting arm. When the shaft is located in the hole and rotated, the contacting arm pivots to contact the tab of the second contact. Because the rotary element is electrically coupled to the first contact and because it can operatively engage with the second contact, a closed circuit is created. When removal of the replacement segment is desired, rotation of the contacting arm to the unengaged position provides the necessary clearance for removal.

With respect to the rail interface elements of the cleaning segment, the first rail interface element (when employed in a cleaning segment) may consist of only one cleaning surface, or the first rail interface element may comprise a cleaning surface and one of the following: a rail extension extending from the cleaning surface or a pair of rail extensions extending in opposite directions from the cleaning surface. In addition to these combinations, the cleaning segment may further comprise, at a lateral distance of about "D" from the first rail interface element, one of the following: a continuous rail, a second cleaning surface, a rail extension extending from a second cleaning surface or a pair of rail extensions extending in opposite directions from a second cleaning surface.

In a second embodiment, an invertable supporting platform having an obverse side and a reverse side is used in conjunction with the cleaning segment of the first embodiment. The obverse side comprises a conventional track segment having at least two rails intended to replace the removed track layout segment. The reverse side comprises the previously described cleaning segment of the first embodiment. A bay dedicated to receiving the platform may be integrated into the layout, or the platform may be adapted to the existing layout.

While the second embodiment uses a vertically removable supporting platform, a third embodiment uses a pivoting supporting platform. In this embodiment, the supporting platform is pivotally linked to a mechanical ground, such as a bay mounted to the layout. The axis of rotation can be orthogonal to track direction, i.e., parallel to the major axis of the ties, or can be parallel to the track direction. Thus, a user need only rotate the supporting platform in order to expose the opposite side.

To facilitate electrical connection between the layout track and the supporting platform, connector means are used, and include the previously described rotary contact arrangement for the first embodiment. If a receiving bay is used, power from the layout can also be delivered via conductor(s) to at least one contact disposed on an internal perimeter wall of the bay, with a complementary contact positioned on an outer portion of the supporting platform with conductor(s) to the desired segment or element. A detent arrangement can also be used to positively locate the supporting platform in the bay and/or act as electrical connector means. This later configuration is especially desirable for use with the third embodiment.

BRIEF DESCRIPTION OF THE DRAWINGS

FIG. 13 is a schematic perspective, exploded view of a fourth embodiment of the invention showing a rotatable wheel cleaning assembly having an axis of rotation parallel to the rail axis and for use with a model railroad track layout;

FIG. 14 is schematic cross section, elevation view of the embodiment of FIG. 13 showing, in phantom, the rotation of the support in a bay;

FIG. 15 is schematic cross section, elevation view of the embodiment of FIG. 13.

DESCRIPTION OF THE EMBODIMENTS

The following discussion is presented to enable a person skilled in the art to make and use the invention. Various modifications to the preferred embodiment will be readily apparent to those skilled in the art, and the generic principles herein may be applied to other embodiments and applications without departing from the spirit and scope of the present invention as defined by the appended claims. Thus, the present invention is not intended to be limited to the embodiment shown, but is to be accorded the widest scope consistent with the principles and features disclosed herein.

In the following paragraphs, reference is made to a model railroad layout. As those persons skilled in the art will appreciate, such a layout is comprised of at least one track having two rails operatively coupled to a source of electrical power for electrifying the track (or possibly overhead catenary wire) in order to operate locomotives and accessories used in conjunction therewith. As used herein, "track" refers to any gauge or scale railway track comprising at least two rails and suitable ties, whether G, O, HO, N, Z or others. These tracks generally come in track segments that are linked to one another in an abutting fashion via couplers to form a continuous track. The tracks are usually anchored to a suitable layout substrate via one or more fasteners engaging the ties, which provides the track with a mechanical ground.

First Embodiment

Figure 1:
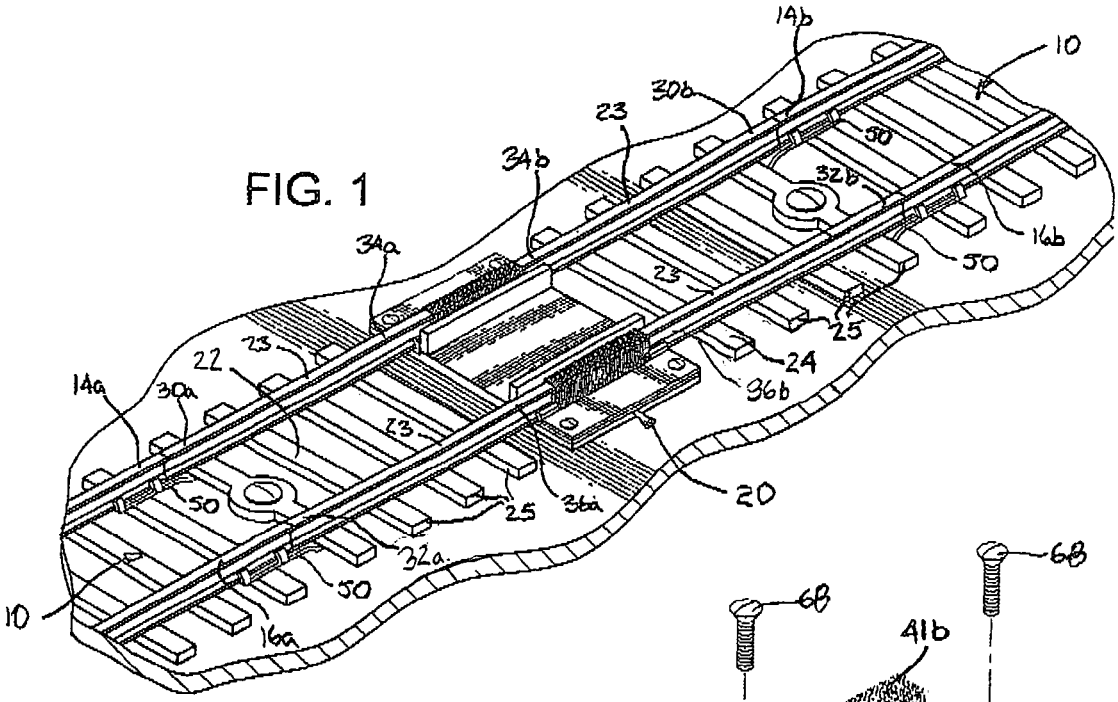
FIG. 1 is a perspective view of a first embodiment of the invention showing the integration of a wheel cleaning assembly with a model railroad track layout.
Figure 2:
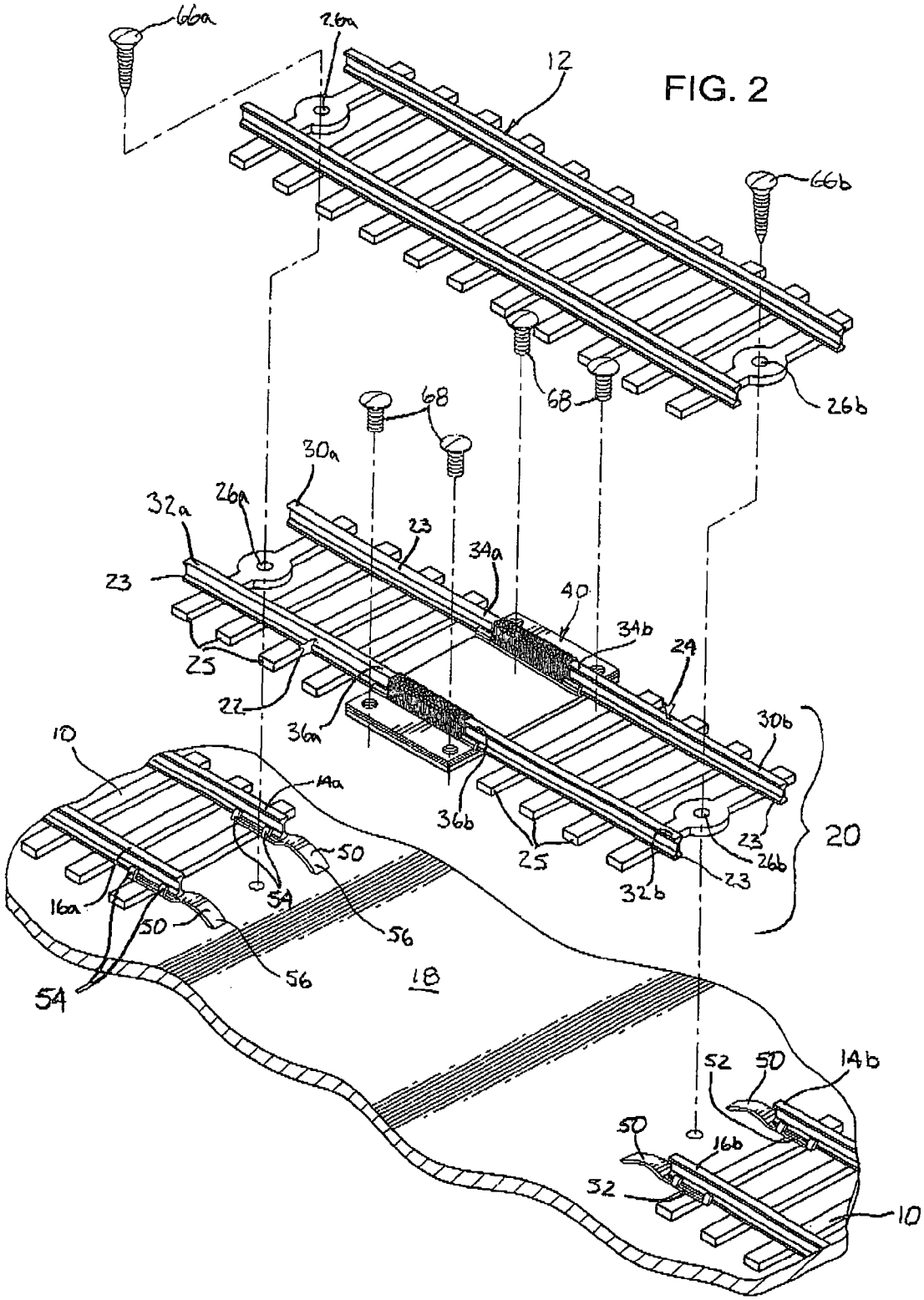
FIG. 2 is a composite perspective, exploded view of the first embodiment illustrating the interchangeability of a conventional track segment and a wheel cleaning assembly in a model railroad track layout.

Turing then to the several Figures wherein like numerals indicate like parts, and more particularly to FIGS. 1 and 2, a first removable embodiment is shown. In this first embodiment, track layout 10 has track segment 12 removed therefrom, leaving space 18, and track ends 14*a*/*b* and 16*a*/*b*. As will be seen below, space 18 may be occupied alternatively by track segment 12 or wheel cleaning segment 20.

Wheel cleaning segment 20 is shown as having first track extension 22, including distal rail ends 30*a* and 32*a*, and proximal rail ends 34*a* and 36*a*. Rails 23 are fixedly positioned in a spaced-apart relationship by ties 25, as is well known in the art. Wheel cleaning segment 20 also has second track extension 24 including distal rail ends 30*b* and 32*b*, and proximal rail ends 34*b* and 36*b*. Again, rails 23 are fixedly positioned in a spaced-apart relationship by ties 25, as is well known in the art.

Figure 4:
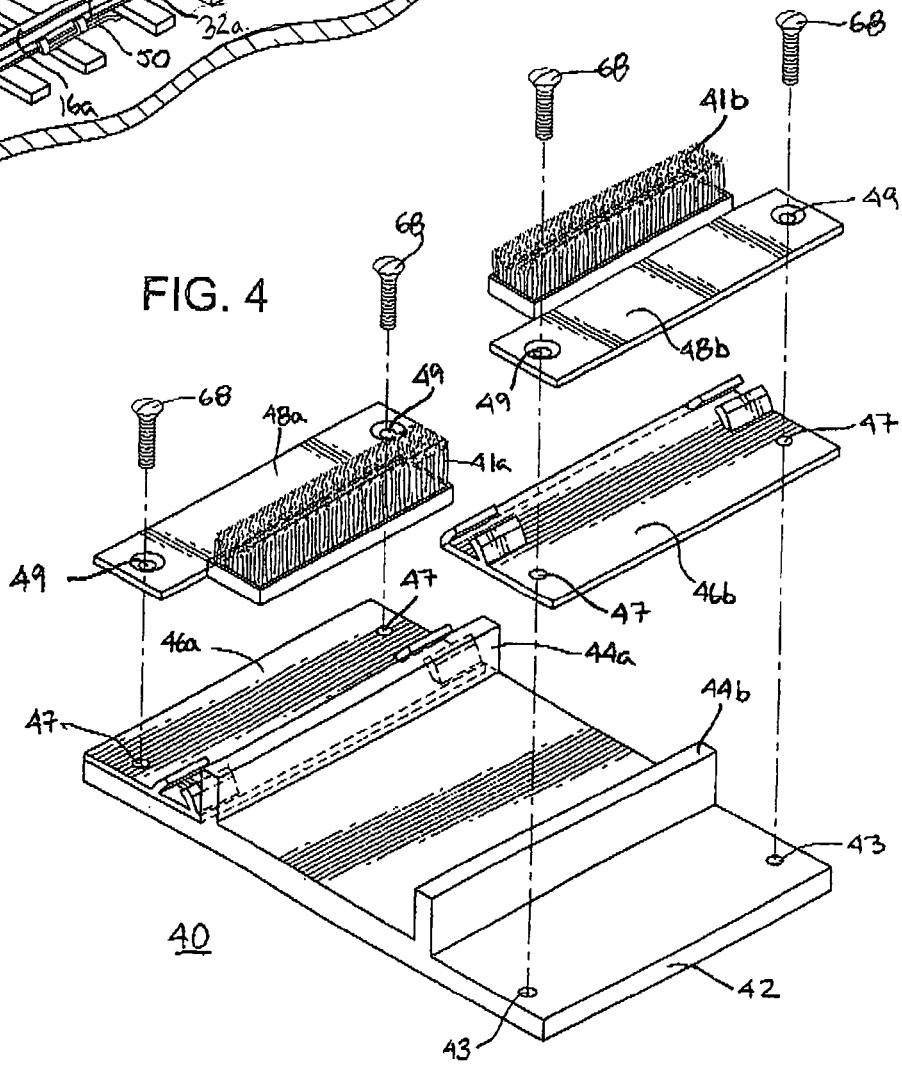
FIG. 4 is a detailed perspective exploded view of a brush assembly used in several embodiments of the invention.

Between track extensions 22 and 24 is located cleaning assembly 40, which is best shown in FIG. 4. Depending upon the application, cleaning assembly 40 may be electrified or not. The disclosed embodiment provides for electrification, however similar efficacy can be achieved by only electrifying track extensions 22 and 24.

Brush assembly 40 includes guide block or base plate 42 to which are attached rail joiners 46*a/b* and brush plates 48*a/b*. Guide block plate 42 defines holes 43 for receiving screws 68 and includes integral guide blocks 44*a/b*, which operate to prevent the wheels of a locomotive and/or car from laterally displacing given the absence of a rail-flange interface at brushes 41*a/b*. Guide block plate 42 is preferably constructed from a dielectric such as plastic. Rail joiners 46*a/b* are preferably constructed from brass or other conductive material, and operate to join track ends 34*a* and 36*a* respectively to track ends 34*b* and 36*b*, and to carry current to brush plates 48*a/b* from the layout. Holes 47 defined by the rail joiners permit attachment thereof to guide block plate 42. Brush plates 48*a/b* define holes 49, and function as a means for positioning and retaining brushes 41*a/b* on guide block plate 42. Both brush plates 48*a/b* and brushes 41*a/b* are preferably constructed from brass or other conductive material; any means for mounting brushes 41*a/b* to brush plates 48*a/b* should function as a suitable conductor, unless it is not desired to pass power there through.

While brush assembly 40 is shown in the several Figures as being part of wheel cleaning segment 20, alternative embodiments have brush assembly 40 acting entirely as the cleaning assembly, i.e., brush assembly 40 interfaces directly with track ends 14*a/b* and 16*a/b*, as those persons skilled in the art will realize. See, for example, FIGS. 13–16 illustrating the exclusion of track extensions 22 and 24. Moreover, the illustrated configuration of brush assembly 40 is presently preferred, however, those persons skilled in the art will appreciate that any means for providing both a rail connection means with at least one brush is contemplated, with or without the preferred inclusion of guide blocks.

An important function of this first embodiment is wheel cleaning segment 20's acquisition of power from track layout 10. Because cleaning segment 20 is intended to be conveniently removable from track 10, means must be provided for permitting quick engagement and disengagement therefrom. To this end, track extensions 22 and 24 define holes 26*a/b*, which permit screws 66 to be inserted there through and to engage with the layout substrate. Thus, by simply disengaging screws 66*a/b* from the substrate, a user may remove wheel cleaning segment 20 and replace it with track segment 12, and vice versa. For similar reasons, track segment 12 also defines holes 26*a/b* for use with screws 66. Again, those persons skilled in the art will appreciate the numerous means by which temporary but secure fastening of either wheel cleaning segment 20 or track segment 12 to the substrate can be achieved. These means include quick disconnect devices.

Also in furtherance of this objective are spring rail contacts 50, which comprise base portion 52, rail engaging returns 54, and spring portion 56. One each of base portion 52 and rail engaging returns 54 are coupled to track ends 14*a/b* and 16*a/b*, thereby leaving spring portion 56 exposed to vertical compression by the bottom portions of track ends 30*a/b* and 32*a/b*. When wheel cleaning segment 20 is place thereon, distal track ends 30*a/b* and 32*a/b* contact and compress spring portions 56 to establish an operative electrical connection between cleaning segment 20 and track 10. Those persons skilled in the art will appreciate that the actual mode of accomplishing power delivery to cleaning segment 20 is largely a matter of design consideration so long as the objectives described herein are met. For example, spring portion 56, which is shown as an arch-like structure, can also be a "C" shaped structure. Other means for establishing power delivery to cleaning segment 20 (or assembly 120) are shown with respect to the second and third embodiments, and illustrate the diversity of alternative means for establishing electrical continuity between track 10 and cleaning segment 20 or assembly 120.

Establishing and operating the first embodiment: Turning to FIGS. 1 and 2, the initial step is to remove track segment 12 and replace it with wheel cleaning segment 20: the user must ensure that there are no obstructions that would prevent the vertical deposition of cleaning segment 20 into space 18, e.g., removal of track segment 12. After so doing, cleaning segment 20 is then lowered to replace track segment 12 and temporarily affixed to the substrate via screws 66. As those persons skilled in the art will readily realize, any viable means for temporarily securing cleaning segment 20 to the substrate such as screws, bolts, two-part mechanical fasteners and magnets are considered within the scope of the invention.

Once wheel cleaning segment 20 has been established in place of track segment 12, the locomotive to be cleaned is placed thereon. Ideally, a means for restraining movement of the locomotive will be used when cleaning segment 20 is electrified. The means can be as simple as the user holding the locomotive in place or permitting only limited linear motion thereof, or as complex as an actuatable stop that activates upon electrification of cleaning segment 20.

From the foregoing, it can be seen that the locomotive undergoing wheel cleaning need not be removed from the layout or handled in any other way beyond a gentle restraining effort. Moreover, in this embodiment a user can modify the nature of the spring rail contacts so as to permit lateral, as opposed to vertical, engagement and disengagement of the cleaning segment or replacement track, as those persons skilled in the art will readily realize.

Second Embodiment

In a second embodiment, wheel cleaning segment 20 is modified to produce wheel cleaning assembly 120, as is best shown in FIGS. 3 and 5–8. In particular, assembly 120 generally comprises wheel cleaning segment 20 (identified as cleaning segment 20' in this embodiment and having all parts formerly associated with cleaning segment 20 indicated with a prime designation) fixedly mounted to obverse side 82 of support platform 80. Assembly 120 also includes track segment 12' mounted to reverse side 84 of support platform 80. Ideally, both cleaning segment 20' and track segment 12' are in opposition to one another so as to preserve symmetry about support platform 80. As will be described in more detail, the invertable nature of the second embodiment is considered an improvement to the first embodiment.

Figure 5:
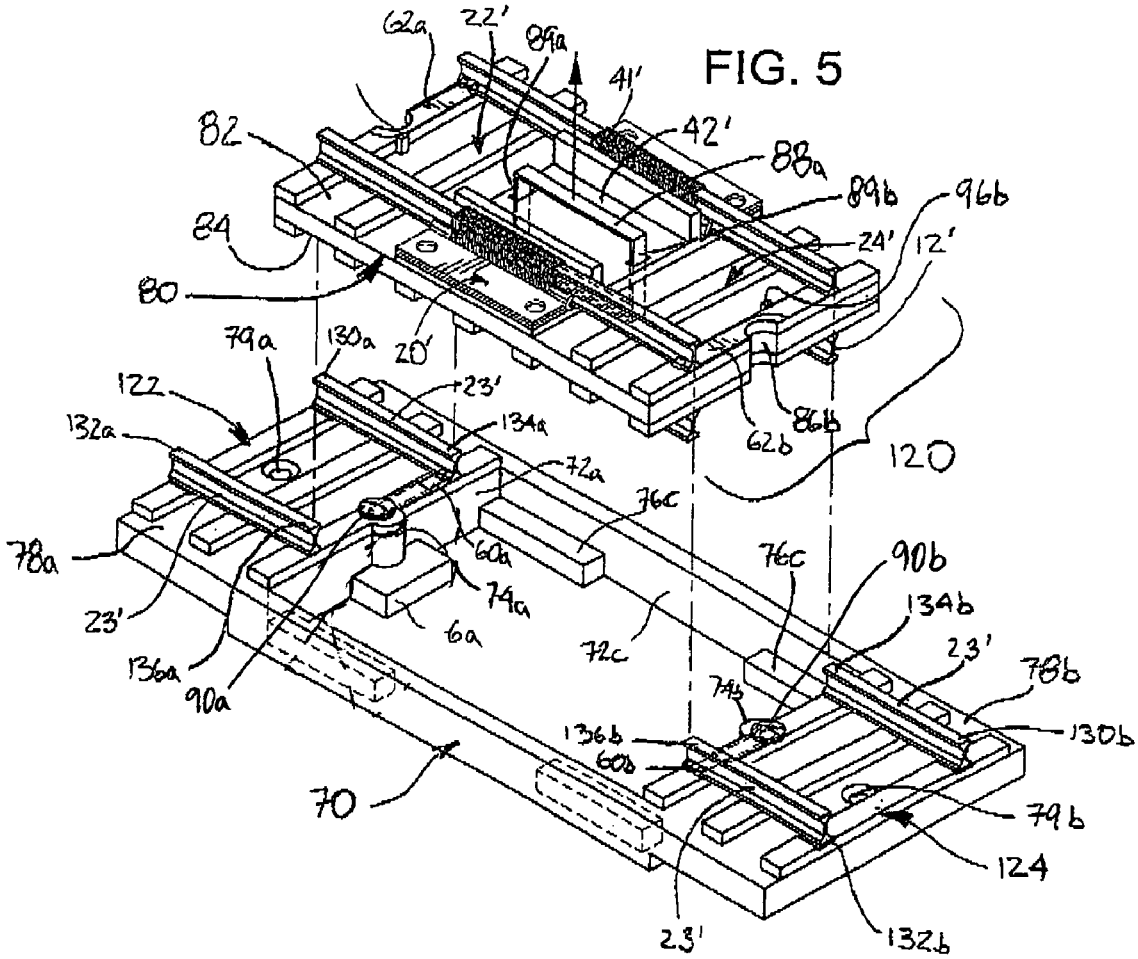
FIG. 5 is a perspective exploded view of the second embodiment of the invention detailing the structure of an invertable support and a bay.
Figure 8:
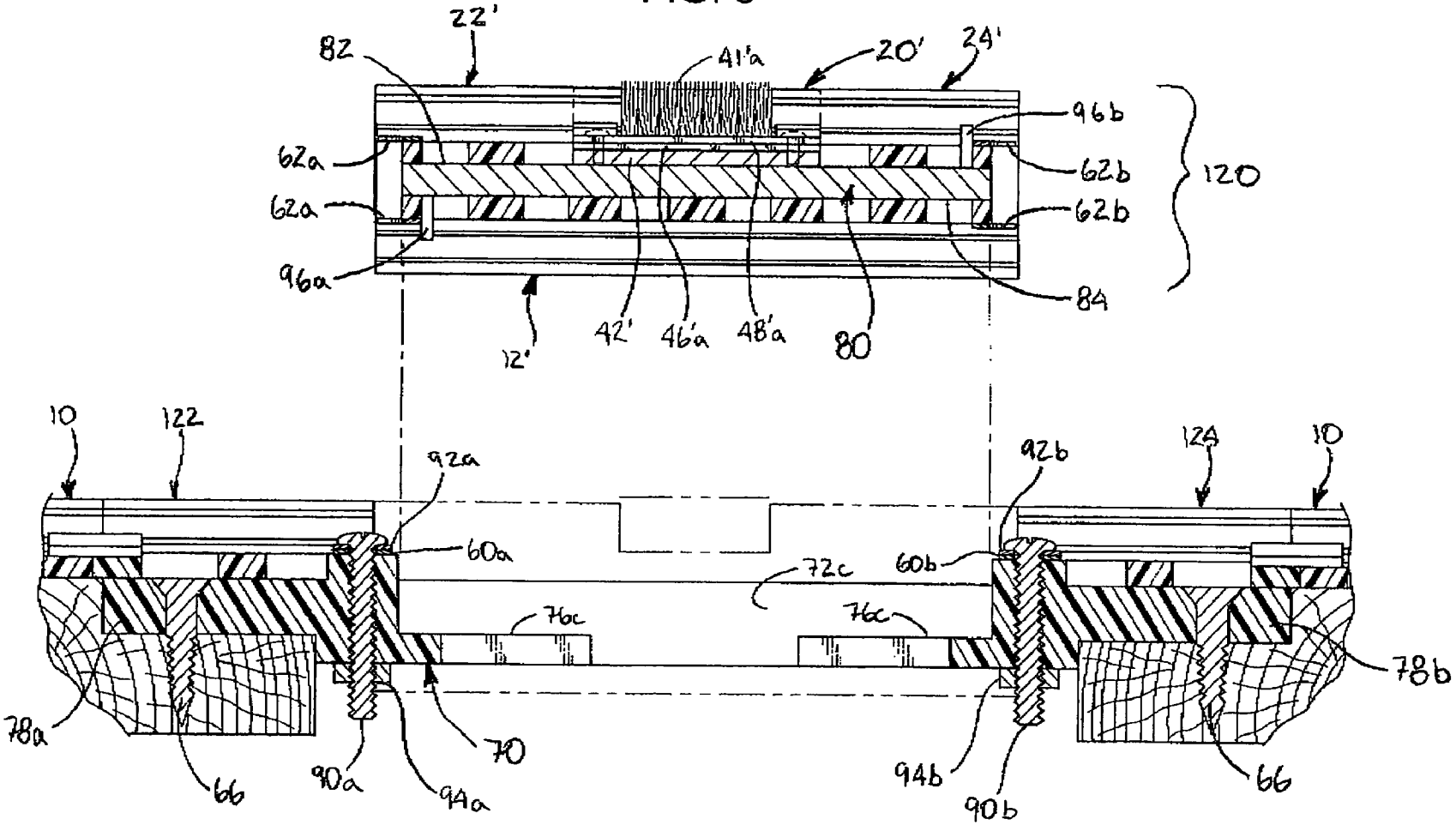
FIG. 8 is an elevation view in cross section taken substantially along the line 8—8 in FIG. 3.

Because assembly 120 has a depth greater than track segment 12, it is necessary to establish sufficient clearance for assembly 120. While even a cutout or hole formed in the layout would be sufficient to hold assembly 120, the second embodiment preferably includes dedicated bay 70, which not only operates to receive assembly 120, but also to provide a means for delivering power to assembly 120 from track 10. As is best shown in FIGS. 5 and 8, bay 70 includes perimeter walls 72*a-d* and tabs 78*a/b*. A bottom wall is optional. Also present are mounting holes 79*a/b* formed respectively in tabs 78*a/b* for securing bay 70 to the layout substrate; vertical guides 74*a/b* to ensure precise alignment of assembly 120 in bay 70; bottom stops 76*a-d* for establishing the proper elevation of support platform 80; layout rail to tie conductors 60*a/b* for tapping power from bay rail segments 122 and 124; and screws 90*a/b* having fixedly attached, extending arms 92*a/b* for conducting power from rail to tie conductors 60*a/b* to rail to tie conductors 62*a/b*. Lastly, bay 70 includes bay track segments 122 and 124 respectively on tabs 78*a/b*. Bay rail segment 122 has distal track ends 130*a* and 132*a*, and proximal track ends 134*a* and 136*a*, and bay rail segment 124 has distal track ends 130*b* and 132*b*, and proximal track ends 134*b* and 136*b*.

To ensure proper orientation of assembly 120 within bay 70, vertical guides 74*a/b* are formed in perimeter walls 72*a/b*, which are complementary in profile to recesses 86*a/b* formed in support platform 80. Depending upon the configuration of assembly 120, additional registration guides may be incorporated or the guides eliminated.

To modulate the depth of assembly 120 within bay 70, a plurality of bottom stops 76 are provided on perimeter walls 72*a–d* of bay 70. The bottom stops may be integral with walls 72*a–d*, or their elevation may be user adjustable such as by use of screws or pins penetrating the relevant wall.

To aid in removing assembly 120 from bay 70, reversible handle 88*a/b* is provided. Vertical members 89*a/b* depend respectively into holes or slots formed in guide block plate 42', and in a normal state, handle 88*a* is in contact with guide block plate 42'. When a user desires to remove assembly 120 from bay 70, handle 88*a* is lifted whereby handle 88*b* (obscured in the drawings, but complementary to handle 88*a*) bears against the ties of track segment 12. A continued lifting force then causes assembly 120 to be removed from bay 70. As is readily apparent, when assembly 120 is inverted handle 88*b* may be lifted and handle 88*a* bears against guide block plate 42'. Those persons skilled in the art will appreciate the myriad of means available to accomplish this objective, and include at least one "I" stud, a string, a push-to-engage and push-to-disengage mechanism, or springs.

Figure 3:
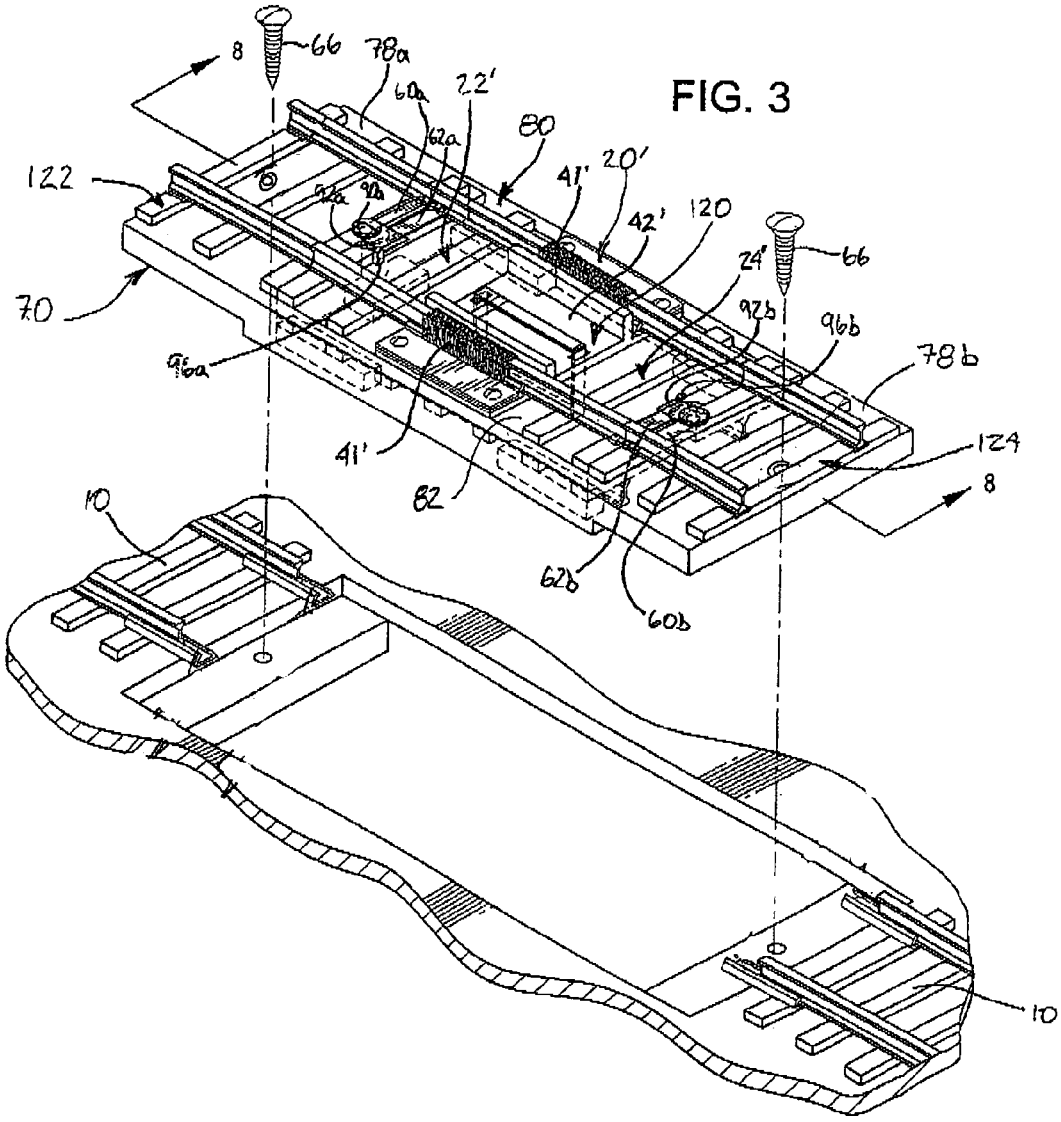
FIG. 3 is perspective exploded view of a second embodiment of the invention showing the integration of an invertable wheel cleaning assembly/conventional track segment with a model railroad track layout.
Figure 6:
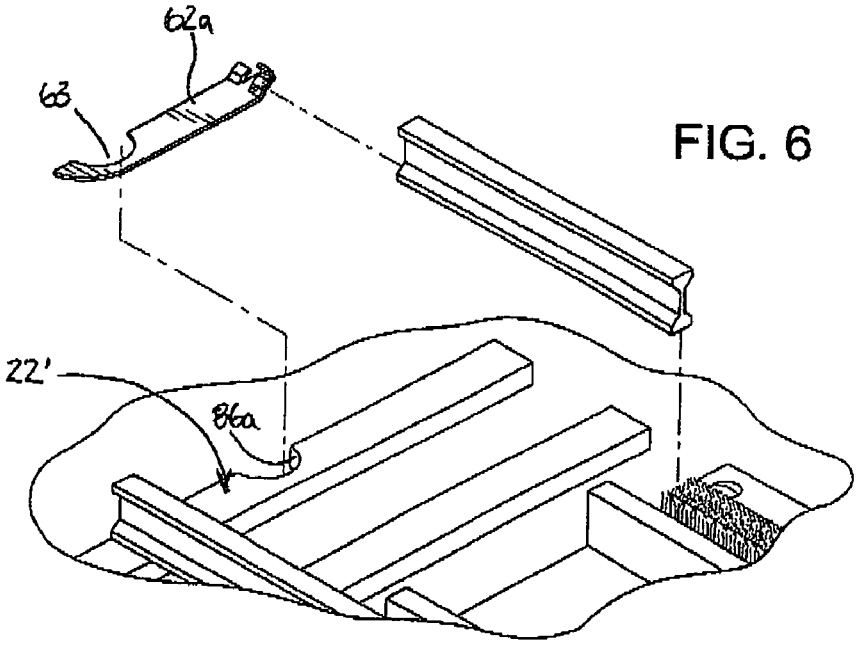
FIG. 6 is a detailed perspective, exploded view illustrating a rail to tie connector used in conjunction with the invertable support of the second embodiment.
Figure 7:
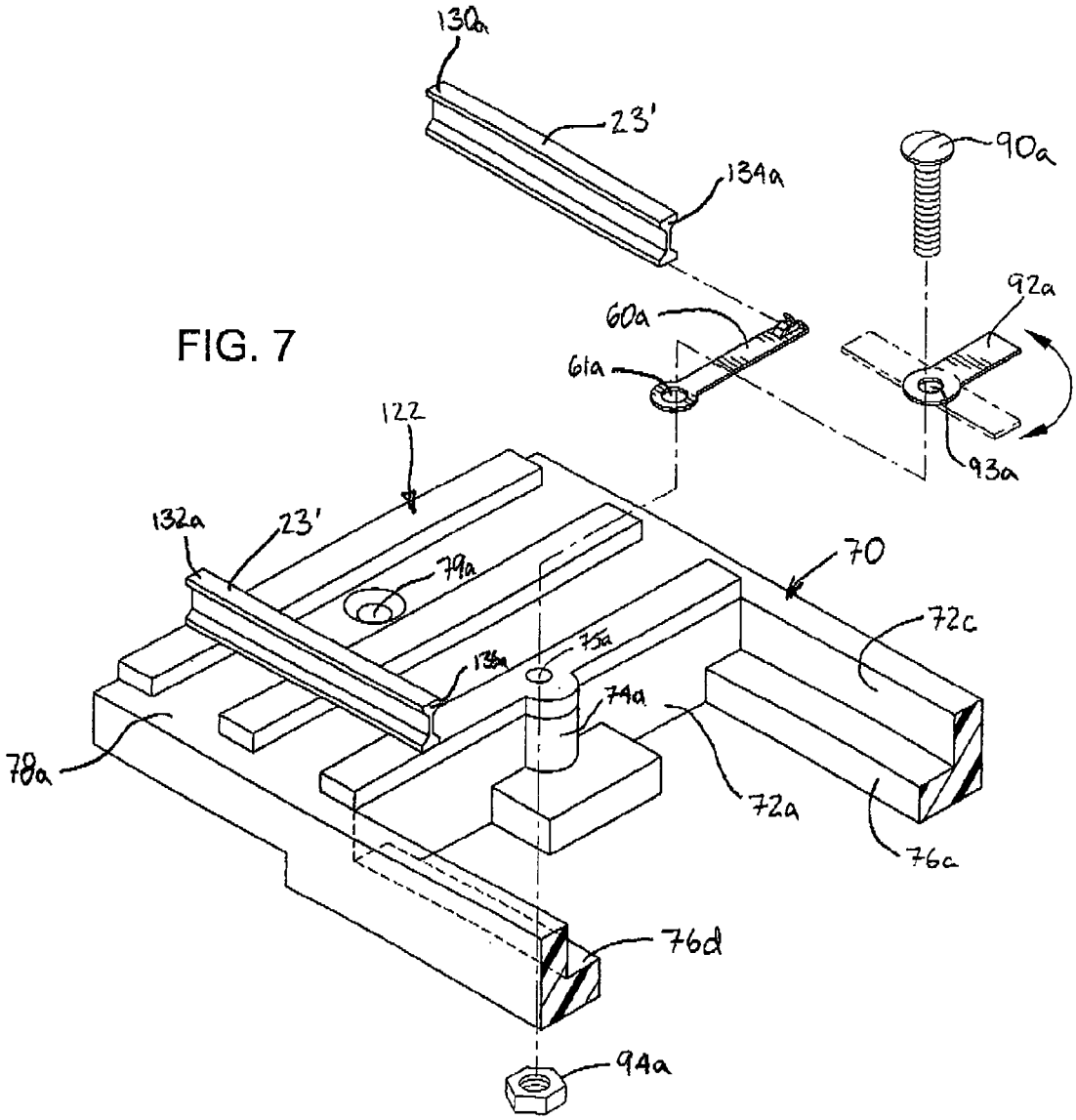
FIG. 7 is a detailed perspective, exploded view illustrating a rail to tie connector and rotary contact used in conjunction with the bay of the second embodiment.

Electrical power from track 10 is provided to bay track segments 122 and 124 by conventional rail joiners linking track 10 to bay track segments 122 and 124, as illustrated FIG. 3. Power from bay track segments 122 and 124 is preferably delivered to assembly 120 by operatively coupling layout to rail conductors 60*a/b* with layout to rail conductors 62*a/b* as will now be described. Because it is not necessary for assembly 120 to establish electrical continuity between bay track segments 122 and 124 (each segment is an electrical "dead end"; it is only desirable to electrify assembly 120 so that track extensions 22' and 24', and optionally brushes 41' are electrified), only two connection means are used. Referring specifically to FIGS. 5–7, rail to tie conductor 60*a* is linked to one rail 23' of bay rail segment 122, and rail to tie conductor 60*b* is linked to one rail 23' of bay rail segment 124 having an opposite polarity. Rail to tie conductor 60*a* engages a rail at track end 134*a* at one end, and hole 61*a* is positioned coaxially with hole 75*a*. Rail to tie conductor 60*b* engages a rail at track end 136*b* at one end, and hole 61*b* (obscured from view) is positioned coaxially with hole 75*b* (obscured from view). Similarly, rail to tie conductor 62*a* engages a rail at one end as shown, and recess 63 is positioned about vertical guide recess 86*a*. Rail to tie conductor 62*b* engages a rail of opposite polarity at one end as shown, and recess 63 is positioned about vertical guide recess 86*b*.

Conductive screws 90*a/b* include arms 92*a/b*, which may be formed therewith or separately attached thereto. As shown best in FIG. 7, screw 90*a* extend through holes 93*a*, 61*a* and 75*a*, and preferably engages nut 94, which may be permanently or removably associated with bay 70 (or eliminated if hole 75*a* is threaded). This arrangement is duplicated with respect to tab 78*b*. Through this arrangement, an arm 92 receives power from a rail 23'. When assembly 120 is inserted into bay 70 (obverse side up) and a screw 90 having an arm 92 extending therefrom is rotated so as to obstruct vertical movement of assembly 120, it compressively contacts a portion of a rail to tie conductor 62 as is shown in FIG. 3. This compressive contact supplies either rail segments 22' or 24', and therefore assembly 20', with suitable power. Over-rotation of arm 92 is prevented by arm stops 96*a/b*, which extend from respective ties as shown best in FIGS. 3 and 5, or from support platform 80. In addition, screws 90*a/b* engage nuts 94*a/b*, which may be permanently or removably associated with bay 70 (or eliminated if hole 75 is threaded). It should be noted that a similar configuration exists with respect to track segment 12' on reverse side 84.

Establishing and operating the second embodiment: Still referring to FIGS. 3, and 5–8, and particularly to FIG. 5, the initial step is to install bay 70 into the layout by inserting screws 66 through tabs 78*a/b* and into the layout substrate (mechanical ground), and establish suitable continuity between the layout and bay track segments 122 and 124 as previously described. After making sure that screws 90 are rotated so that arms 92 are perpendicular to bay track segments 122 and 124, assembly 120 is lowered into place with either obverse side 82 or reverse side 84 exposed. Vertical guides 74 interact with vertical guide recesses 86, ensuring that proper support orientation is achieved, and stops 76, interacting with support platform 80, prevent support platform 80 from exiting bay 70.

If obverse side 82 is exposed, then screws 90 are rotated approximately 30–90°, thereby causing arms 92 to similarly rotate. Over-rotation is prevented by the abutment of arms 92 with stops 96, at which time arms 92 are generally parallel to track extensions 22' and 24'; preferably, arms 92 are sufficiently rotated to compressively contact respective rail to tie conductors 62*a/b*. If reverse side 84 is exposed, then a similar procedure is practiced. Removal is accomplished by reversing the order of installation, and by using handles 88*a/b* as needed. It therefore can be seen that by simple rotation of screws 90*a/b* (approximately 30–90°), support platform 80 can be removed, inverted, replaced and re-secured by again rotating screws 90*a/b*.

As was the case with cleaning segment 20, numerous alternatives to the disclosed means for providing power to assembly 120 are contemplated. For example, biased surface contacts operatively coupled to track extensions 22' and 24', and to track segment 12 may be used at one or more of the perimeter walls 72*a/b* in conjunction with complementary structure associated with assembly 120 (see FIG. 11). Moreover, detents or similar locate and hold arrangements can be used to secure support platform 80 in bay 70 (see FIG. 12).

Third Embodiment

Figure 9:
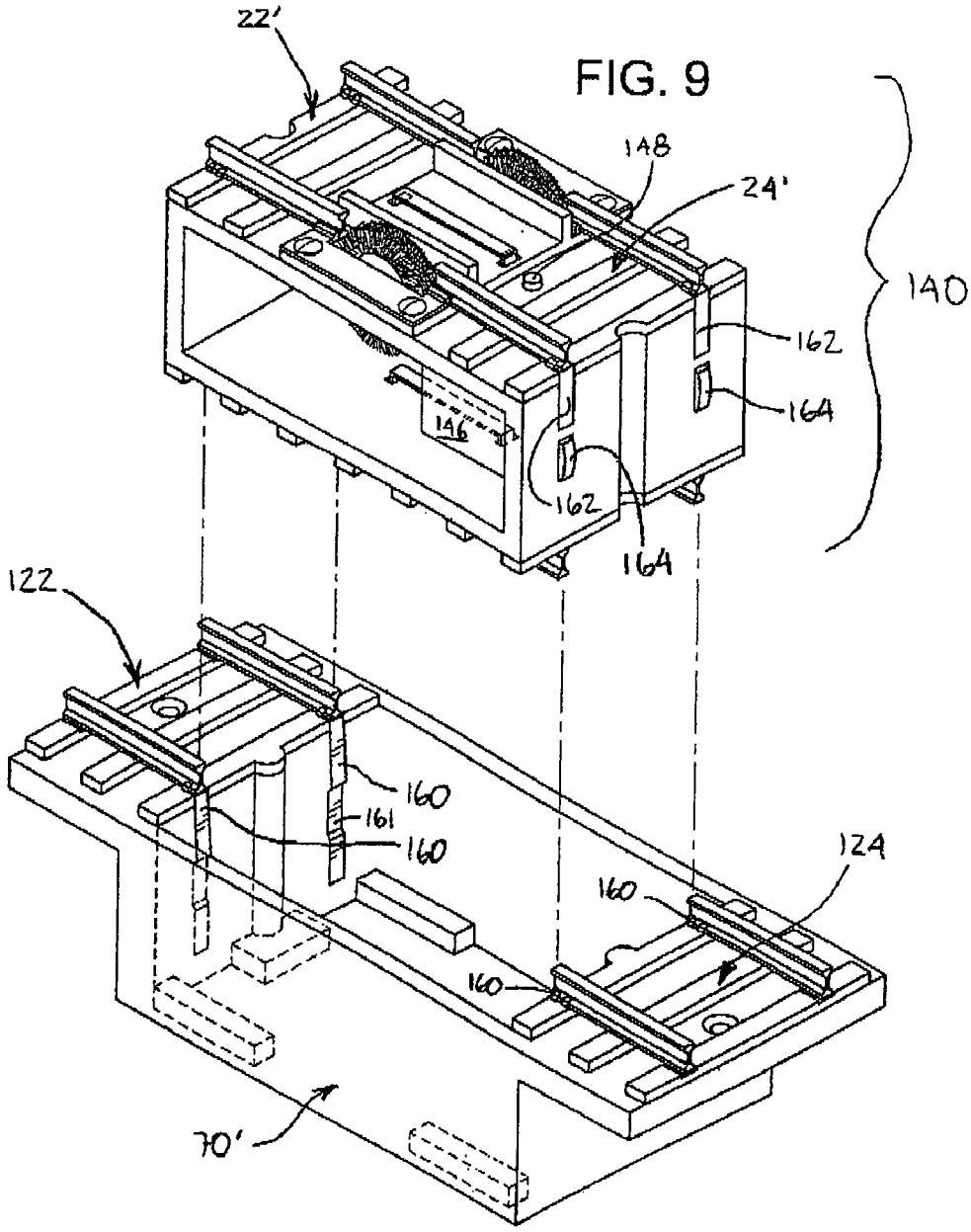
FIG. 9 is a perspective exploded view of a third embodiment of the invention schematically illustrating the inclusion of a powered wheel cleaner.
Figure 10:
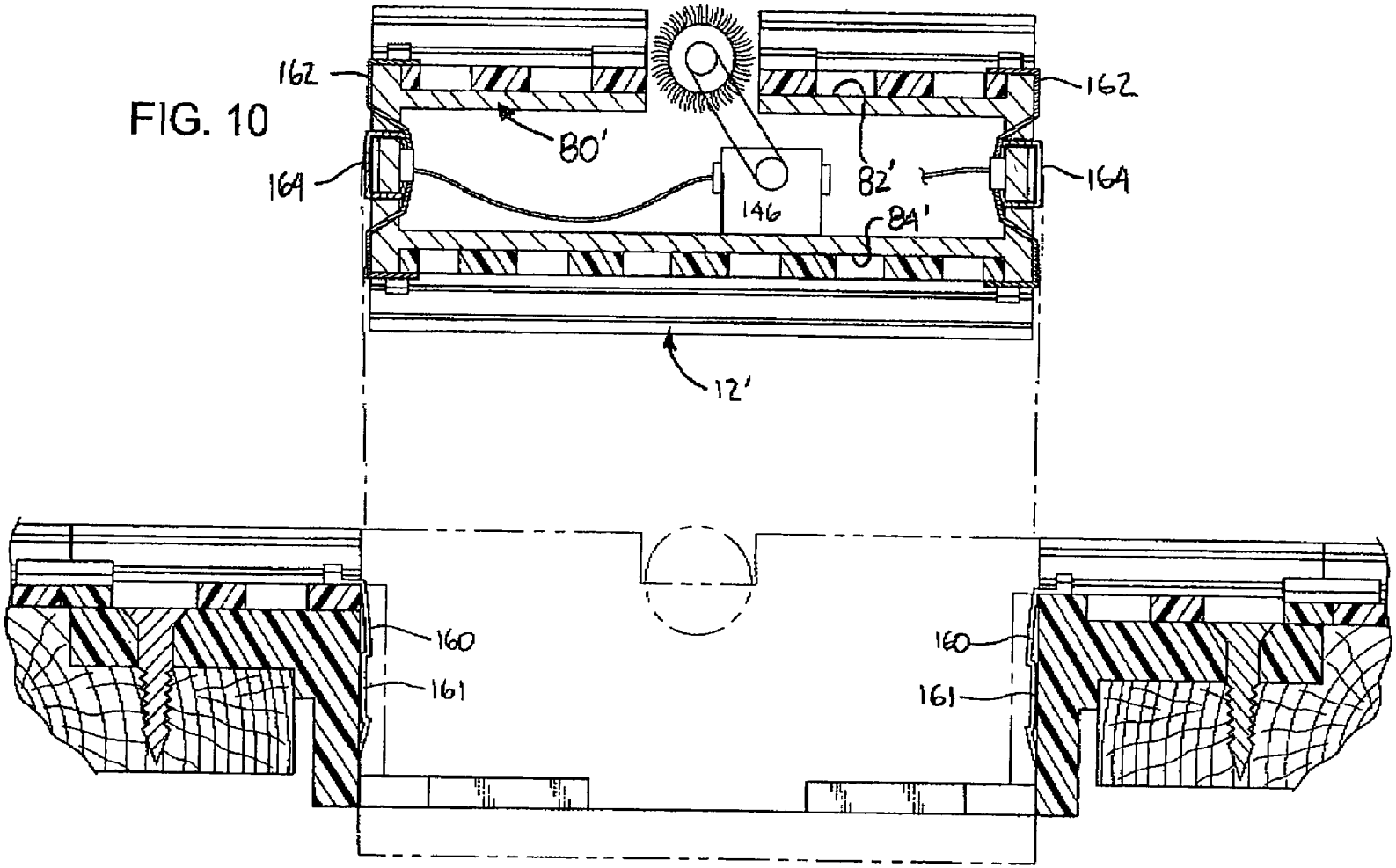
FIG. 10 is a cross section elevation view of the third embodiment in conjunction with part of a model railroad track layout.
Figure 11:
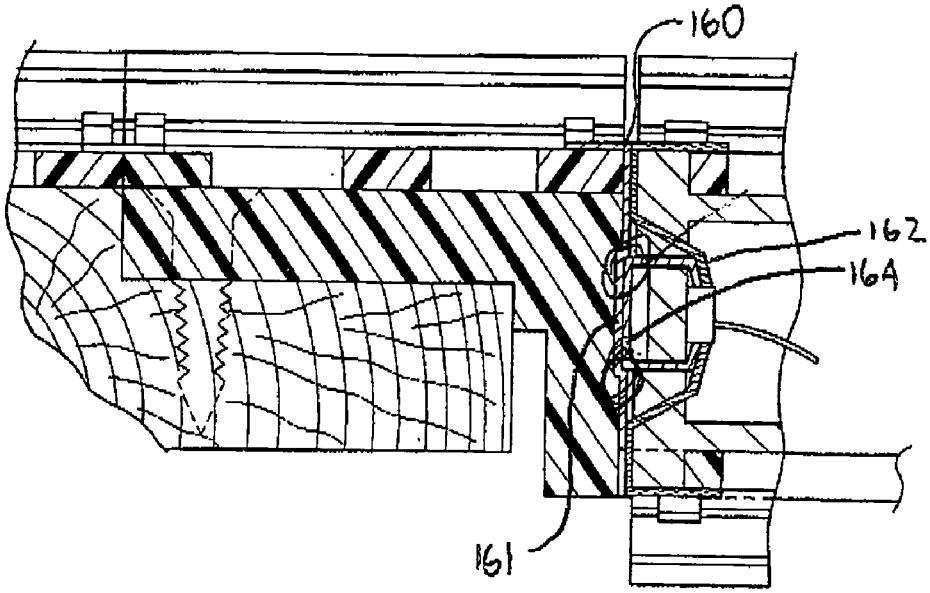
FIG. 11 is a detailed cross section, elevation view of one means for transferring power from a model railroad track layout to the support of the third embodiment of FIG. 10.
Figure 12:
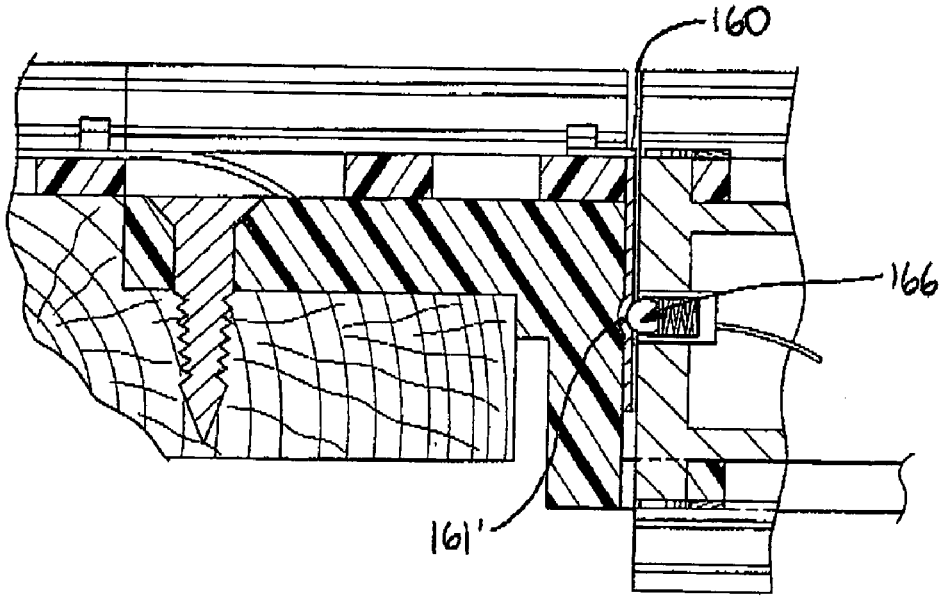
FIG. 12 is a detailed cross section, elevation view of another means for transferring power from a model railroad track layout to the support of the third embodiment of FIG. 10.

FIGS. 9–12 show an active or powered wheel cleaning assembly. Here, any desirable variety of wheel cleaning elements are integrated with assembly 120 (or logically with cleaning segment 20), with rotary cleaning assembly 140 being shown. Alternatively or in addition to rotary cleaning assembly 140, vibrating cleaning elements can be used. While power delivery means such as that described with respect to the second embodiment is equally applicable to this third embodiment, taps 160 extending from bay rail segment 122 and 124 or a separate power source can be used (because active cleaning elements are used, it is not necessary, although it remains desirable, to provide power to rail extensions 22' and 24' or the elements themselves). Taps 160 can be configured to operatively accept corresponding taps 162, which are coupled to rail extensions 22' and 24' as shown. Two different means for coupling taps 160 with taps 162 are shown in FIGS. 9–11 and 12. In FIGS. 9–11, a leaf spring biased means is shown, while in FIG. 12 a compression spring biased means is shown. In the first instance, tap 160 includes recessed portion 161, which in conjunction with the adjacent extending portions of tap 160 create a deformable contact surface. Similarly, contact portion 164 of tap 162 has resilient characteristics, thereby permitting a light compression interlock between taps 160 and 162. Moreover, because contact portion 164 is sized to fit within recessed portion 161, unintentional vertical movement of support 80' is minimized. In the second instance, conductive ball and spring assembly 166 interfaces with detent 161' of tap 160', thereby accomplishing the desired connection. Power may then be delivered to rail extensions 22' and 24' and/or motor 146 of rotary cleaning assembly 140. In the event that a user desires to disable motor 146, button switch 148 (see FIG. 9), which is a SPST switch, is used in conjunction with motor 146 and its power leads.

Fourth Embodiment

Yet another embodiment is shown in FIGS. 13–15. In this embodiment, rather than relying upon removal-replacement or removal-inversion, wheel cleaning assembly 220 relies upon rotation of support platform 280. In many respects, this embodiment is a modification of support platform 80 and bay 70: it eliminates rail extensions 22 and 24 (or rail extensions 22' and 24'), and modifies support platform 80 (now identified as support platform 280) and bay 70 (now identified as bay 270) to provide rotation of support platform 280. In this embodiment, pivot shafts 288*a/b* extend from the central longitudinal axis of support platform 280 and are rotationally received by corresponding pillow blocks 274*a/b* formed in bay 270. Caps 276*a/b* are fixedly (and optionally removably) attached to pillow blocks 274*a/b* to prevent unintentional escapement of support platform 280. Preferably, lateral sides 286*c/d* of support platform 280 are curved so as not to interfere with bay 270, and include captive poppets 290*a/b* that locate in corresponding detents 276 formed in opposing perimeter walls 272*c* and 272*d* of bay 270. In a preferred embodiment, power taps extend from the rail ends to one detent location (according to any of the power delivery means described herein or as known to a skilled person in the art), and similarly to the opposing detent location. Thus, it is only necessary to establish electrical continuity between captive poppets 290*a/b* and conductive brushes 41 (and also corresponding track elements of track segment 212) to have a functional apparatus. Naturally, power can be delivered to brushes 41 via shafts 288.

Figure 16:
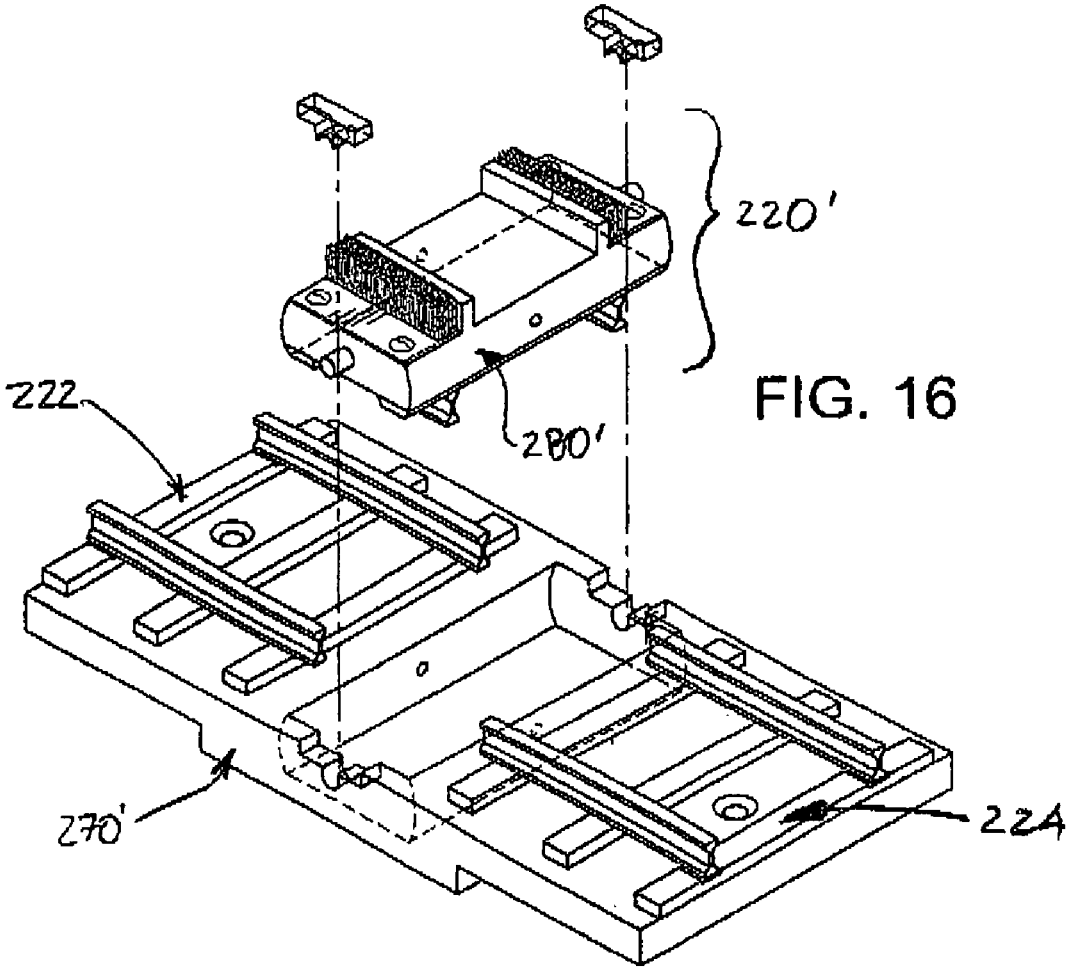
FIG. 16 is a schematic perspective, exploded view of a fourth embodiment of the invention wherein the axis of rotation is perpendicular to the rail axis.

A variant of this embodiment is shown in FIG. 16, the significant modification being the axis of rotation. Thus, bay 270' has been modified as well as support 280' as shown.

What is claimed:

1. In a model railroad layout comprising a track secured to a mechanical ground and having a first rail spaced apart by a distance "D" from a second rail, and a track segment removed therefrom to establish a space, a first track end and a second track end, a removable in-situ wheel cleaning apparatus for model railroad locomotives and/or cars adapted to operate on the track comprising:

a cleaning segment sized to removably fit within the space and comprising a first rail interface element spaced apart from a second rail interface element by approximately distance "D" wherein the first rail interface element comprises a cleaning surface for contacting the rail contacting surface of at least one wheel of a model railroad locomotive and/or car placed thereon; and at least one connector means for electrical coupling the first rail with the first rail interface element when the cleaning segment occupies the space created by the removed track segment.

2. The apparatus of claim 1 wherein the connector means comprises a spring rail contact having a conductor receiving base portion and at least one biased rail contacting portion extending from the base portion.

3. The apparatus of claim 2 wherein the connector means is coupled to one of the layout rails and the biased rail contacting portion extends into the space created by the removed segment.

4. The apparatus of claim 1 wherein the connector means comprises a first contact having a conductor receiving portion and defining a hole;

a second contact having a conductor receiving portion and a tab wherein the second contact is located proximate to the first contact when the cleaning segment occupies the space created by the removed track segment; and a conductive rotary element having a shaft and an extending contacting arm whereby when the shaft is located in the hole and rotated, the contacting arm contacts the tab of the second contact.

5. The apparatus of claim 4 wherein the first contact conductor receiving portion is operatively linked to the first rail and the second contact conductor receiving portion is operatively linked to the first rail interface element of the cleaning segment.

6. The apparatus of claim 1 wherein the connector means functions to retain the cleaning segment to the mechanical ground.

7. The apparatus of claim 1 wherein the first rail interface element further comprises one of a rail extension extending from the cleaning surface or a pair of rail extensions extending in opposite directions from the cleaning surface, and wherein the second rail interface element comprises one of a continuous rail, a second cleaning surface, a rail extension extending from a second cleaning surface or a pair of rail extensions extending in opposite directions from a second cleaning surface.

8. The apparatus of claim 1 wherein the second rail interface element further comprises a cleaning surface for contacting the rail contacting surface of at least one wheel of the model railroad locomotive and/or car placed thereon, and at least two connector means for electrical coupling the first rail with the first rail interface element and the second rail with the second rail interface element when the cleaning segment occupies the space created by the removed track segment.

9. The apparatus of claim 1 further comprising at least one guide block adjacent to one of the first or second rail interface elements to limit lateral movement of the model railroad locomotive and/or car when a portion thereof is placed on the conductive abrasive surface.

10. The apparatus of claim 1 further comprising a source of motive power operatively linked to the first rail interface element whereby upon application of power to the source of motive power, the cleaning surface is caused to move.

11. In a model railroad layout comprising a track secured to a mechanical ground and having a first rail spaced apart by a distance "D" from a second rail, and a track segment removed therefrom to establish a space, a first track end and a second track end, a removable in-situ wheel cleaning apparatus for model railroad locomotives and/or cars adapted to operate on the track comprising:

a support platform having an obverse side and a reverse side, and sized to fit within the space created by the removed track segment;

a track segment affixed to the obverse side comprising a first rail spaced apart from a second rail by approximately distance "D" whereby when the support platform occupies the space created from the removed track segment and is abutted against the first and second track ends, and the obverse side is oriented up, the track segment is substantially coextensive with the first and second track ends; and a cleaning segment affixed to the reverse side comprising a first rail interface element spaced apart from a second rail interface element by approximately distance "D" wherein the first rail interface element comprises a cleaning element whereby when the support platform occupies the space created from the removed track segment and is abutted against the first and second track ends, and the reverse side is oriented up, the first and second rail interface elements are substantially coextensive with the first and second track ends.

12. The apparatus of claim 11 further comprising at least one connector means for acquiring electrical power from a layout rail and delivering it to at least the track segment.

13. The apparatus of claim 12 wherein the conductor means comprises:

a first contact having a conductor receiving portion and defining a hole;

a second contact having a conductor receiving portion and a tab wherein the second contact is located proximate to the first contact when the cleaning segment occupies the space created by the removed track segment; and a conductive rotary element having a shaft and an extending contacting arm whereby when the shaft is located in the hole and rotated, the contacting arm contacts the tab of the second contact.

14. The apparatus of claim 13 wherein the first contact conductor receiving portion is operatively linked to the first rail and the second contact conductor receiving portion is operatively linked to one rail of the track segment.

15. The apparatus of claim 11 further comprising at least one connector means for acquiring electrical power from a layout rail and delivering it to at least the cleaning segment wherein the at least one cleaning element comprises a conductive surface; and the second rail interface comprises one of a continuous rail, a second cleaning element comprising a conductive surface, a rail extension extending from a second cleaning element comprising a conductive surface or a pair of rail extensions extending in opposite directions from a second cleaning element comprising a conductive surface.

16. The apparatus of claim 11 wherein the second rail interface comprises one of a continuous rail, a second cleaning element comprising a conductive surface, a rail extension extending from a second cleaning element comprising a conductive surface or a pair of rail extensions extending in opposite directions from a second cleaning element comprising a conductive surface; and at least two connector means for electrical coupling the first layout rail with the first rail interface and the second layout rail with the second rail interface when the cleaning segment occupies the space created by the removed track segment.

17. In a model railroad layout comprising a track secured to a mechanical ground and having a first rail spaced apart by a distance "D" from a second rail, and a track segment removed therefrom to establish a space, a first track end and a second track end, a wheel cleaning assembly for model railroad locomotives and/or cars adapted to operate on the track comprising:

a replacement track segment comprising a first rail spaced apart from a second rail by approximately distance "D" whereby when the replacement track segment occupies the space created from the removed track segment and is abutted against the first and second track ends, the replacement track segment is substantially coextensive with the first and second track ends;

a cleaning segment comprising a first rail interface element spaced apart from a second rail interface element by approximately distance "D" wherein at least one rail interface is electrically conductive and wherein the first rail interface element comprises a cleaning element whereby when cleaning segment occupies the space created from the removed track segment and is abutted against the first and second track ends, the first and second rail interface elements are substantially coextensive with the first and second track ends; and a first connector means for acquiring power from the first layout rail to electrically link the first layout rail with one of the first replacement track segment first rail or the first rail interface, and a second connector means for acquiring power from the second layout rail to electrically link the second layout rail with one of the second replacement track segment second rail or the second rail interface.

18. The apparatus of claim 17 wherein the first and second connector means are selected from the group consisting of a spring rail contact, a rotary contact arrangement, a lateral contact arrangement using power taps where the replacement track segment and the cleaning segment are removable relative to the track layout, and a lateral contact arrangement using power taps where the replacement track segment and the cleaning segment are rotatable relative to the track layout.

19. The apparatus of claim 17 wherein the replacement track segment and the cleaning track segment are affixed in symmetrical opposition to a common support platform that is rotatably positioned relative to the track layout so that the replacement track segment is exposed and is coextensive with the first and second track ends, and upon rotation the cleaning track segment is exposed and is coextensive with the first and second track ends.

20. The apparatus of claim 18 further comprising a bay for receiving the support platform wherein the bay includes a pair of track extensions whereby when the bay is integrated into the layout track, the extensions are substantially coextensive with the first and second track ends and one of the rails of the replacement track segment or the first and second rail interface elements of the cleaning segment.

* * * * *